US006176017B1

(12) United States Patent
Sato et al.

(10) Patent No.: US 6,176,017 B1
(45) Date of Patent: Jan. 23, 2001

(54) ELECTRIC KITCHEN KNIFE

(75) Inventors: Katsunori Sato, Sumoto; Shigehiro Uemura, Kyoto, both of (JP)

(73) Assignee: Sanyo Electric Co., Ltd., Moriguchi (JP)

( * ) Notice: Under 35 U.S.C. 154(b), the term of this patent shall be extended for 0 days.

(21) Appl. No.: 09/217,205

(22) Filed: Dec. 22, 1998

(30) Foreign Application Priority Data

Dec. 25, 1997 (JP) ..... 9-356956

(51) Int. Cl.[7] ..... B26B 7/00; B26D 3/30

(52) U.S. Cl. ..... 30/277.4; 30/298.4; 30/296.1; 83/762

(58) Field of Search ..... 30/272.1, 277.4, 30/296.1, 298, 298.4, 762, 286, 124; 83/762

(56) References Cited

U.S. PATENT DOCUMENTS

| | | | | |
|---|---|---|---|---|
| 116,412 | * | 6/1871 | Chapman | 30/298.4 |
| 789,889 | | 5/1905 | Sutherland . | |
| 1,491,623 | * | 4/1924 | Pitchur | 30/298.4 |
| 2,789,349 | * | 4/1957 | Lee | 30/298.4 |
| 2,904,087 | | 9/1959 | Walthall . | |
| 3,316,636 | * | 5/1967 | Raper, Jr. et al. | 30/277.4 |
| 3,418,713 | * | 12/1968 | Bauer | 30/277.4 |
| 3,432,702 | * | 3/1969 | Chambers | 30/277.4 |
| 3,664,021 | * | 5/1972 | Sawyer | 30/277.4 |
| 4,399,989 | | 8/1983 | Baillie . | |
| 5,361,666 | | 11/1994 | Kensrue . | |
| 5,486,259 | | 1/1996 | Goodwin et al. . | |
| 5,638,734 | | 6/1997 | Fish . | |
| 5,673,608 | | 10/1997 | DeMars . | |
| 5,690,013 | | 11/1997 | Kanarek et al. . | |
| 5,718,158 | | 2/1998 | Rogge . | |
| 5,946,998 | | 9/1999 | Thompson . | |

* cited by examiner

*Primary Examiner*—Hwei-Siu Payer
(74) *Attorney, Agent, or Firm*—Wenderoth, Lind & Ponack, L.L.P.

(57) ABSTRACT

The electric kitchen knife has blades (2) connected to the front end of a main housing (5), and the blades (2) move in reciprocal motion to cut food. The main housing (5) has a stand leg (6) projecting from the bottom surface positioned away from the center of gravity towards the blade end. The stand leg (6) maintains the main housing (5) in an upright standing position. Held by the stand leg (6) in an upright standing position on a table (7), the front end of the main housing (5) is raised separating the blades (2) from the table (7).

7 Claims, 6 Drawing Sheets

ELECTRIC KITCHEN KNIFE

This application is based on application No. 9-356956 filed in Japan on Dec. 25,1997, the content of which is incorporated hereinto by reference.

BACKGROUND OF THE INVENTION

This invention relates to an electric kitchen knife for cutting food such as bread or meat with reciprocating blades.

An electric kitchen knife has blades connected to the end of a main housing. The blades are moved back and forth by a driving mechanism in the main housing to quickly cut food. The blades which move back and forth are two knife blades layered together without a gap and having reciprocating motion in mutually opposing directions. Each of the two knife blades has a serrated food cutting edge serrated. The two serrated knife blades are moved in mutually opposing reciprocating motion to quickly cut foods such as bread or meat. In particular, this type of electric kitchen knife has the characteristic that it can cut food such as soft bread, without applying strong pressure, into well formed slices.

An electric kitchen knife used in this manner is provided with a hand grip on the upper surface of the main housing, and has long narrow blades connected to the main housing and projecting in a straight line from the front of the main housing.

Incidentally, an electric kitchen knife is convenient to use if it can be placed on a horizontal work stand in an upright or standing orientation. This is because when cutting food such as bread or meat, the electric kitchen knife is not always continuously held and is occasionally placed on the kitchen counter or table when temporarily not in use. Even when using a standard kitchen chopping knife to cut food, the knife is not held all the time. A standard kitchen knife is held when cutting food, but it is placed down when exchanging food to be cut or when changing the arrangement or orientation of the food. The electric kitchen knife is used in the same manner to cut food by sometimes holding the knife and sometimes placing it on the kitchen counter or table.

A related art electric kitchen knife is provided with a horizontal surface on the bottom of the main housing thereby allowing it to stand upright on a table. A main housing with a narrow horizontal surface cannot stand upright in a stable fashion. For this reason, the main housing is tapered so that it becomes wider towards the bottom to make the horizontal bottom surface wider.

This type of electric kitchen knife has the drawback that the blades connected to the end of the main housing are easily hit on the kitchen counter or table when the main housing is placed in an upright orientation on the counter or table. If the blades strike the kitchen counter or table, the surface of the counter or table becomes marred or the blades are damaged and become dull. In particular, since the blades are connected to the lower end of the main housing to allow the blades to completely cut through food, this type of electric kitchen knife has the drawback that the edges of the blades easily strike on the kitchen counter or table when placing the knife in an upright position. If the blades are connected to the upper end of the main housing, the blades do not strike the kitchen counter or table, but it becomes difficult to completely cut through food to separate it into pieces with the blades connected towards the top of the main housing.

Further, it is necessary to widen the bottom surface of the main housing for an electric kitchen knife which stands upright on a horizontal surface provided on the bottom of the main housing. Therefore, this configuration has the drawback that it is difficult to make an overall design with a neat good looking outward appearance.

Still further, as shown in the oblique view of FIG. 1, the electric kitchen knife is used in conjunction with a food holder 101 which holds food in a specific orientation. FIG. 1 shows a food holder for slicing a bread type known as bagels into two pieces. This food holder 101 has guide slits which guide the blades 102 connected to the electric kitchen knife main housing 105 and vertical plates 104 which hold bread between the plates. If this food holder 101 is used, bread can be accurately and safely sliced into two pieces. When bread held in this type of food holder 101 is sliced with an electric kitchen knife, the reciprocal motion blades 102 cuts through to the bottom end of the guide slits 103, and thus, damage to this region can occur.

The present invention was developed with the object of eliminating these types of drawbacks. Thus it is a primary object of the present invention to provide an electric kitchen knife with an extremely simple structure which can be placed in an upright standing position on a table, and further which can reliably prevent the blades from damaging the table or from the blades being damaged by the table when the knife is positioned on the table.

Another important object of the present invention is to provide an electric kitchen knife having a main housing with a clean good looking design, and also when used together with a food holder, damage to the food holder can be reliably prevented.

The above and further objects and features of the invention will more fully be apparent from the following detailed description with accompanying drawings.

SUMMARY OF THE INVENTION

The electric kitchen knife of the present invention has a main housing containing a driving mechanism for blades which cut food by reciprocal motion, and blades connected to the end of the main housing and moved in reciprocal motion by the driving mechanism contained in the main housing.

Further, the electric kitchen knife is provided with a stand leg projecting from the bottom surface of the main housing towards the blade end of the main housing away from the center of gravity to make the main housing stand in an upright position. This stand leg is configured to hold the front end of the main housing up in order to separate the blades from the table when the main housing is in an upright standing position.

The main housing of this type of electric kitchen knife can be placed on a table in a standing attitude by implementation of an extremely simple structure. In addition, this structure has the characteristic that when placed on a table, damage to the table by the blades connected to the main housing and damage to the blades by the table are reliably prevented. This is because this electric kitchen knife has a stand leg which projects out from the bottom surface of the main housing near the blade end of the main housing away from its center of gravity. The stand leg not only allows the main housing to stand alone in an upright position, but also raises the front end of the main housing when in the upright position on a table to separate the blades from the table.

Further, since the stand leg provided on the bottom surface of the main housing of this electric kitchen knife allows the main housing to stand alone in an upright position, there is no necessity to form a main housing with a wider base as in a related art electric kitchen knife. Therefore, the main housing can be designed in a clean good looking form.

Finally, when this electric kitchen knife cuts food held by a holder, it has the characteristic that damage to the holder by the blades can be effectively prevented. This is because the blades are prevented from traveling to the very bottom position of the holder by the stand leg on the main housing of the knife.

DETAILED DESCRIPTION OF THE INVENTION

Figure 1:
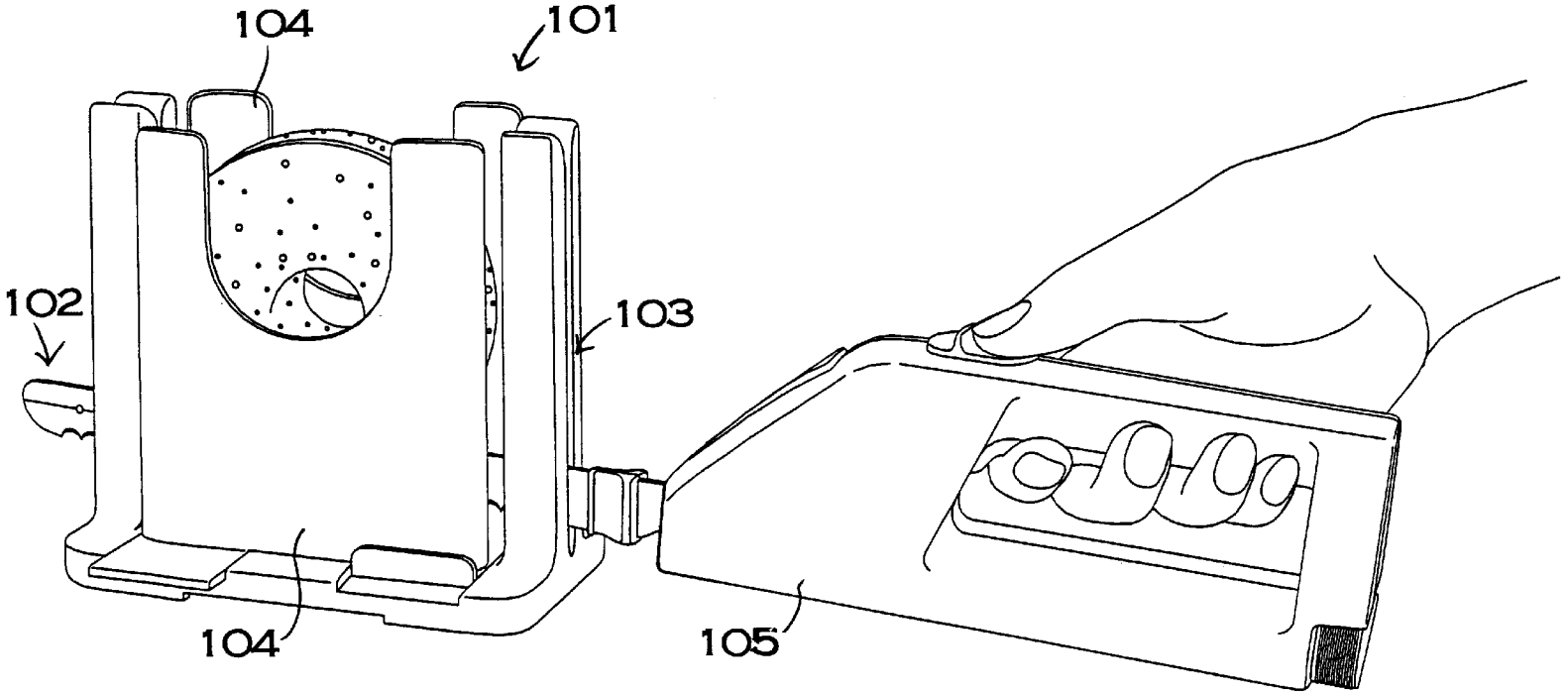
FIG. 1 is an oblique view showing an embodiment of a conventional electric kitchen knife in use.
Figure 2:
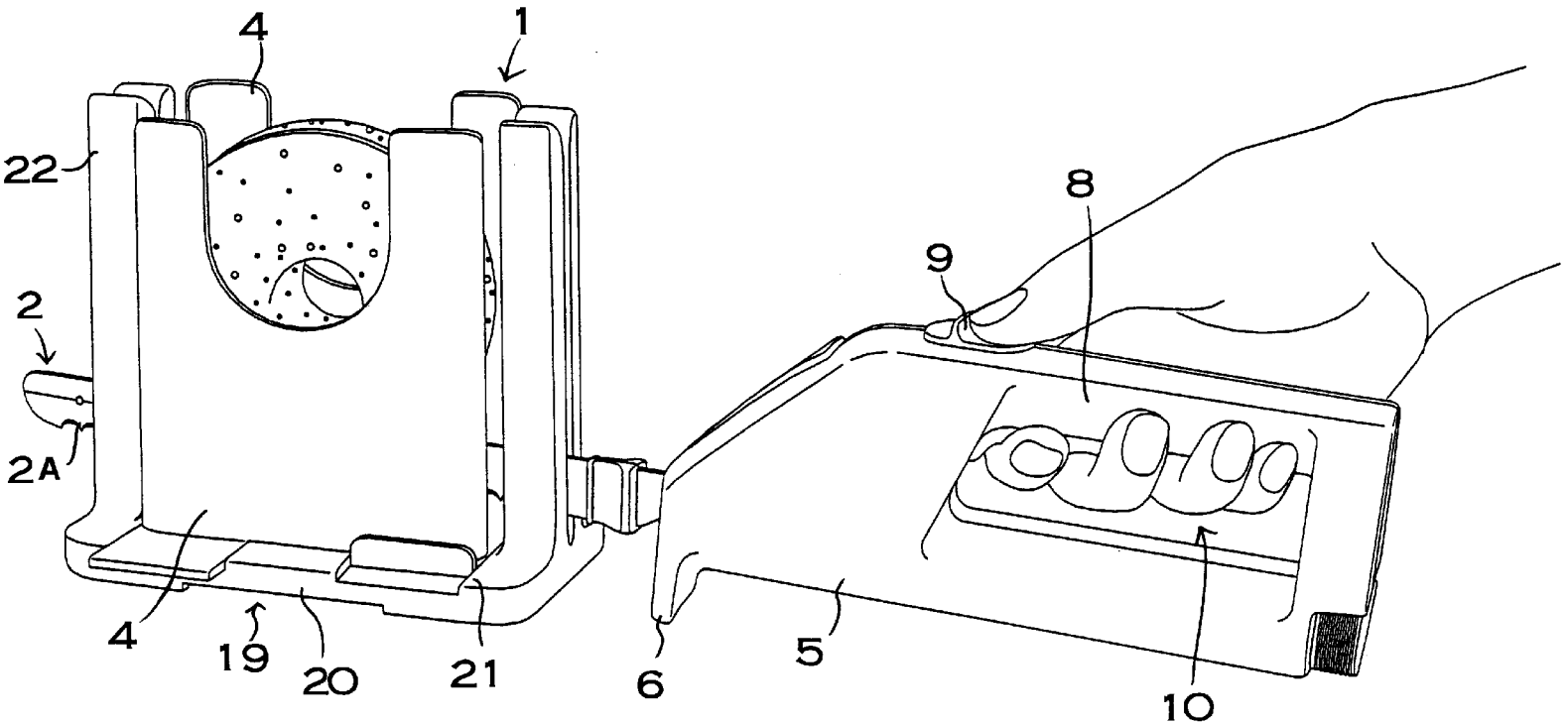
FIG. 2 is an oblique view showing an embodiment of the electric kitchen knife of the present invention in use.

The electric kitchen knife shown in FIG. 2 has a main housing 5 and blades 2 which are movable in reciprocal motion and are connected to the front end of the main housing 5.

The main housing 5 is a plastic case formed as two pieces, left and right, joined together and provided with a fore and aft extending grip 8 in its upper portion. The grip 8 has grooves formed along its lower surface which conform to a user's fingers and insure a reliable handhold. The upper surface of the grip 8 is provided with a slide switch 9 which turns on and off the driving mechanism for moving the blades in reciprocal motion.

The main housing 5 is formed in an overall long narrow shape fore and aft, is provided with a long narrow fore and aft opening 10 in its central region, and the region above this opening 10 is the grip 8. The blades 2 connect to the front end of the long narrow main housing 5 in a manner which freely allows attachment and detachment.

Figure 3:
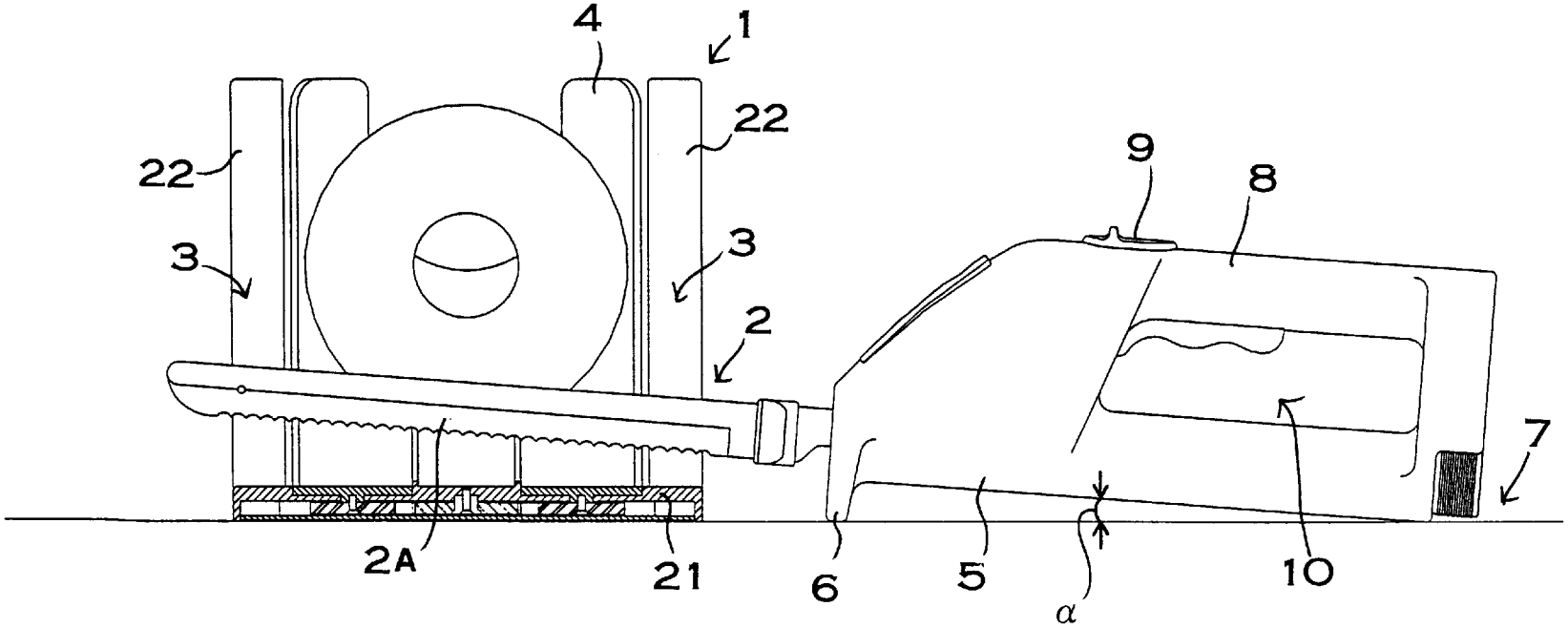
FIG. 3 is a side view partially in cross-section showing an embodiment of the electric kitchen knife of the present invention on a table in an upright standing position.

Further, the main housing 5 is provided with a stand leg 6 projecting from the bottom surface of the housing away from its center of gravity near the blade end of the housing to stand the main housing 5 in an upright orientation. In the main housing 5 shown in the figures, the stand leg 6 is established at the bottom of the front end of the housing which connects with the blades 2. However, the stand leg of the electric kitchen knife of the present invention is not always necessarily located at the front end of the main housing as long as it is established forward of the center of gravity towards the blade end of the main housing. As shown in FIG. 3, the stand leg 6, established on the blade side of the main housing center of gravity, raises the front end of the main housing 5 to separate the blades 2 connected to the main housing 5 from the table 7 when the main housing 5 is in the upright position. If the stand leg 6 is made taller, the angle of inclination $\alpha$, indicating the positive slope from the main housing 5 towards the blades 2, becomes larger, and the distance of separation of the blades 2 from the table 7 increases. Conversely, if the stand leg 6 is made shorter, the angle of inclination $\alpha$ of the main housing 5 decreases and the blades 2 are positioned nearer to the table 7. Further, the angle of inclination $\alpha$ of the main housing 5 also varies depending on the overall length of the main housing 5. Even if the height of the stand leg 6 does not change, a longer main housing 5 reduces its angle of inclination $\alpha$. The optimum height of the stand leg 6 is determined considering the overall length of the main housing 5. For example, the angle of inclination $\alpha$ of the main housing 5 is set between 3° and 20°, and preferably between 5° and 15°.

The bottom edge of the stand leg 6 rests on the table 7 to keep the main housing 5 in an upright position on the table 7 in a stable fashion. If the width of the stand leg 6 is narrow, the main housing 5 cannot remain upright on the table 7 in a stable fashion and can easily fall to one side. Consequently, the width of the bottom edge of the stand leg 6 is set to a width which can maintain the main housing 5 in a stable upright position, for example 10 mm to 30 mm, and preferably 15 mm to 25 mm. The bottom edge of the stand leg 6 is formed so as horizontal or a concave region is established at its center with both ends contacting the table 7.

Although not illustrated, the main housing 5 contains a driving mechanism to move the connected blades 2 in reciprocating motion. Any mechanism that is presently in use or can be developed in the future, which can move the blades 2 in reciprocating motion, can be used as the driving mechanism.

The driving mechanism contained in the main housing 5 is provided with two connecting sheaths for connection of two blades in a detachable manner, a reciprocating motion mechanism for moving the two connecting sheaths with reciprocal motion in mutually opposing directions, a motor for driving the reciprocating motion mechanism, and a battery pack for producing motor rotation. The reciprocating motion mechanism is a mechanism for converting motor rotation to reciprocating motion. For example, the reciprocating motion mechanism may be configured with a cam shaft fixed to the rotating shaft of the motor, and a connecting rod with one end connected to the cam shaft and the other end connected to a connecting sheath. The two connecting sheaths are contained within the main housing in a manner allowing reciprocal motion, for example, via flexible arms capable of distorting resiliently.

The battery pack is inserted into the rear end of the lower portion of the main housing in a detachable manner. By housing the battery pack in the rear lower portion of the main housing, the center of gravity can be moved to a low aft position due to the weight of the batteries. Namely, the lower aft end of the main housing can be made heavy. This main housing has the characteristic that the blades connected to the front end of the electric kitchen knife can be raised away from the table in a stable manner due the weight of the battery pack. The battery pack attached to the main housing can be detached from the main housing, charged, and used again repeatedly.

The reciprocating motion mechanism has a cam shaft which is rotated by the motor, this cam shaft moves the connecting rod in reciprocal motion, and the connecting rod moves a connecting sheath in reciprocal motion. For a reciprocating motion mechanism which moves two blades 2 with reciprocating motion in mutually opposing directions, a mechanism such as the one which moves two rows of inner blades of an electric razor with reciprocating motion in mutually opposing directions can be used. For example, two shafts with a 180° phase angle can be provided for the cam shaft fixed to the motor, connecting rods can be connected to each of these shafts, each connecting rod can connect to a connecting sheath, and the two connecting sheaths can be moved with reciprocating motion in mutually opposing directions.

Figure 4:
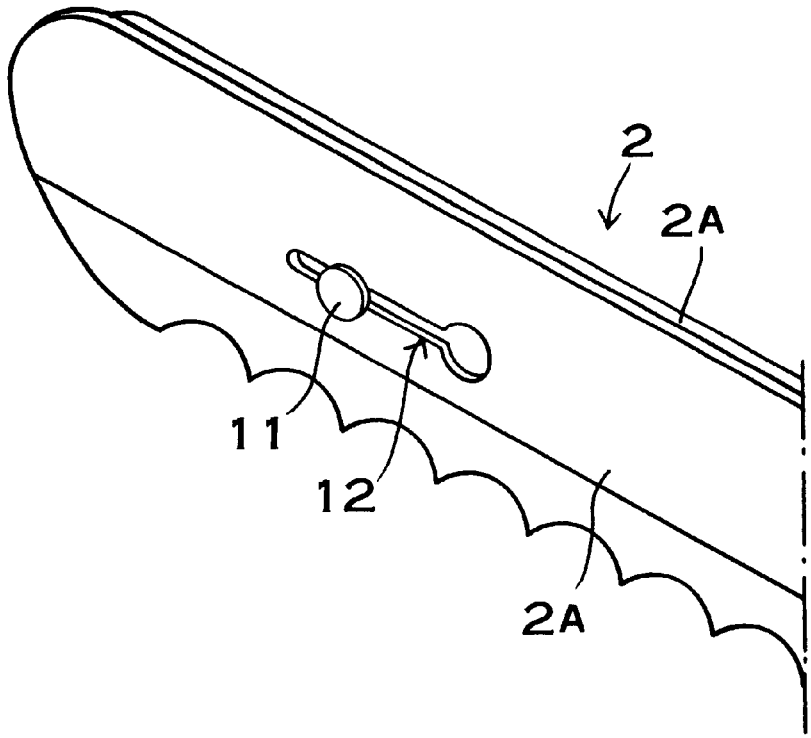
FIG. 4 is an oblique view showing a connection of the two blades.

The blades 2 are two knife blades 2A which are connected in a manner allowing mutual reciprocal motion. The knife blades 2A connect together at the tip region in a manner allowing them to slide in close contact, and connect to the main housing 5 by insertion of their aft ends into the main housing connecting sheaths. Connection of the knife blades 2A at their tip regions is shown in FIG. 4. In the blades 2 of FIG. 4, an undercut projection 11 is fixed to the knife blade 2A on one side, and a slit 12 into which this projection inserts is provided through the knife blade 2A on the other side. The projection 11 is a circular rod with a head fixed on the end taking on a mushroom shape. The height of the circular rod is approximately the same as the knife blade 2A thickness.

The slit 12 is provided with a large hole at one end allowing insertion of the projection 11 head. The slit 12 is opened through the knife blade 2A extending in the direction of knife blade reciprocal motion, and its width is approximately equal to, or slightly wider than the outside diameter of the circular rod portion of the projection 11. The projection is guided in the slit for moving the two blades in mutual reciprocal motion. Further, the overall length of the slit 12 is made longer than the stroke of the reciprocal motion of the two knife blades 2A, and the projection 11 moves in reciprocal motion in the central region of the slit 12. This prevents the projection 11 from hitting the front edge of the slit 12 or moving as far as the large hole when the two knife blades 2A are in reciprocal motion, and results in smooth reciprocal motion.

Since the two knife blades 2A are moved with reciprocating motion in mutually opposing directions, this type of blade 2 has the characteristic that food can be sliced extremely smoothly. However, it is needless to say that the blade(s) connected to the main housing may also be a single knife blade instead of two knife blades.

Figure 5:
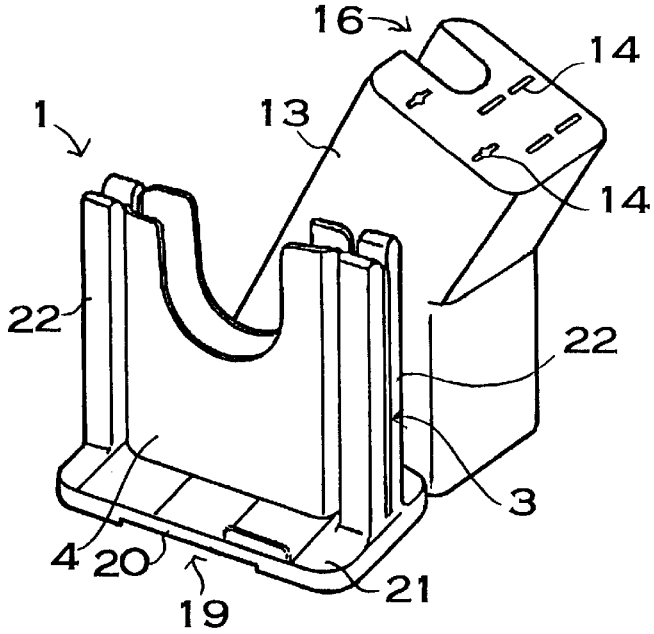
FIG. 5 is an oblique view showing an electric kitchen knife holding stand.
Figure 6:
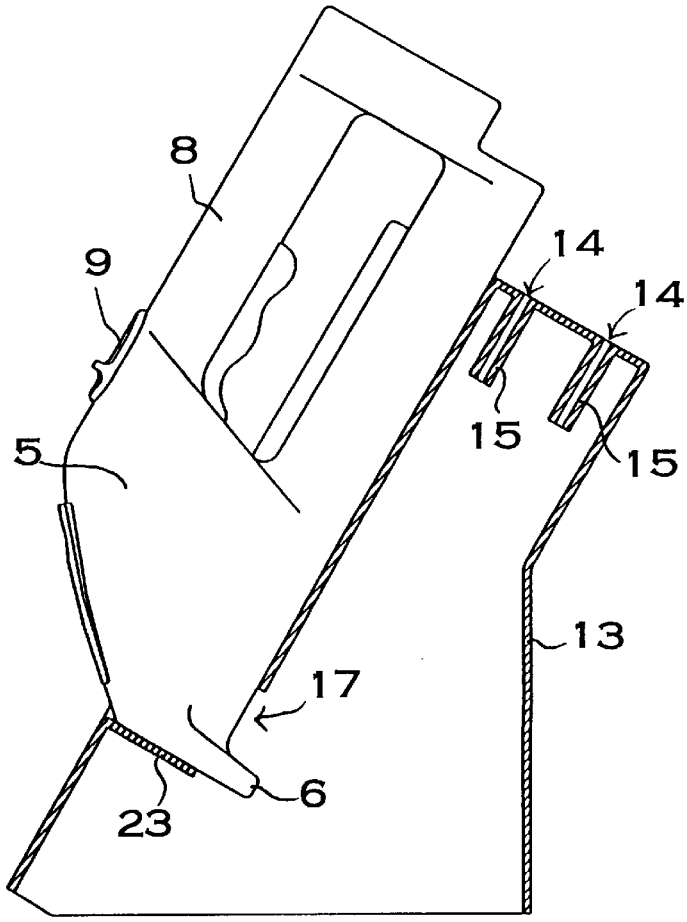
FIG. 6 is a cross-sectional view of the electric kitchen knife attached to the knife holding stand.

The blades 2 are connected to the main housing 5 when the electric kitchen knife is in use. Blades 2 not in use are removed from the main housing 5 and are inserted into and stored in a knife holding stand 13 as shown in FIG. 5. The stand 13 shown in FIG. 5 is formed from plastic in a hollow box shape. This stand 13 is formed as an inclined rectangular cylinder that becomes wider towards the bottom. On the top surface of the upper end of the rectangular cylinder, retaining holes 14 are provided for allowing insertion and storage of two sets of blades and four knives. In the stand 13 shown in FIG. 5, blade retaining holes 14 are disposed on the left side and knife retaining holes 14 are disposed on the right side. As shown in the cross-sectional view of FIG. 6, guide sheaths 15 inside the top surface of the rectangular cylinder are formed as a single piece with the rectangular cylinder to enable the retaining holes 14 to hold blades in a specified orientation within the stand 13. Further, since the knife retaining holes 14 are opened in a side-to-side orientation, knife blade and retaining hole 14 damage during knife insertion and removal can be reduced. This is because when retaining holes are opened in an up-and-down orientation and a knife blade is inserted and removed with the blade pointing down, the weight of the knife itself results in contact between the blade and the bottom edge of the retaining hole. This situation does not occur for retaining holes with a side-to-side orientation.

In addition, the stand 13 shown in the figures is provided with an attachment groove 16 for attachment of the main housing 5, with blades removed, at the center region of the upper side surface which is a sloping surface of the inclined rectangular cylinder. The attachment groove 16 is formed in a shape which allows the bottom of the main housing 5 to mate with the groove in a manner which supports the main housing 5 in an upright position. Namely, the attachment groove 16 is formed in a shape which conforms to the bottom of the main housing 5. Further, the attachment groove 16 is provided with a support surface 23 for holding the front end of the main housing 5. The main housing 5 attaches in the attachment groove 16 in a manner resting on the support surface 23, and the stand leg 6 at the front end of the main housing 5 inserts into a void 17 provided at the front end of the attachment groove 16. This retains the stand 13 in a stable configuration.

Figure 7:
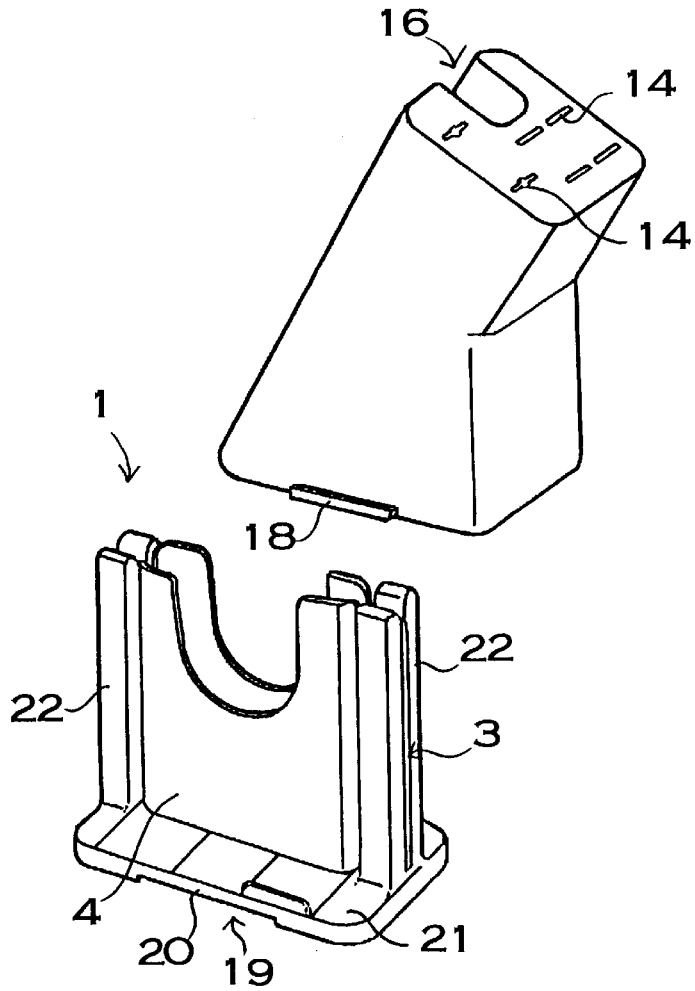
FIG. 7 is an oblique view showing the electric kitchen knife holding stand and a food holder.
Figure 8:
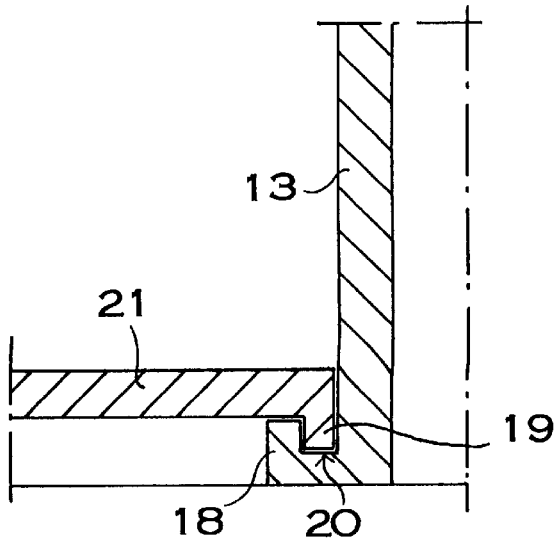
FIG. 8 is an enlarged cross-section view of the region of the knife holding stand which connects to the food holder.

As shown in FIG. 7, the stand 13 is provided with a projecting piece 18 formed as a single piece with the stand 13 protruding from the side of the stand 13 for connection with a food holder 1 used together with the electric kitchen knife. As shown in the cross-sectional view of FIG. 8, the projecting piece 18 is hooked with the perimeter side-wall 20 of the food holder 1 to connect the stand 13 with the food holder 1. The projecting piece 18 is provided along the side surface of the stand 13. The bottom edge of the perimeter side-wall 20 of the food holder 1, which mates with the projecting piece 18, is provided with a recessed region 19 for insertion of the projecting piece 18. If the stand 13 and the food holder 1 can be connected in specified positions, they have the characteristic that they can both be packed in specified positions. Further, the stand 13 and the food holder 1 have the characteristic that when not in use, they can be connected together and the food holder I can be stored with the stand 13 on places such as the kitchen counter.

The food holder 1 holds food to be sliced with the electric kitchen knife. The food holder 1 is provided with two vertical plates 4 disposed in parallel mutually opposing positions to retain food in the gap between the parallel plates, a base 21 to which the vertical plates 4 are attached in a perpendicular fashion, and knife guides 22 attached perpendicular to the base 21 on both sides of the gap created between the two parallel vertical plates 4 and having guide slits 3 extending up-and-down the knife guides. With this food holder 1, a knife can be moved through guide slits 3 of the knife guide 22, and food held in the gap between the two vertical plates 4 can be sliced at the center into two pieces.

In this food holder 1, the two vertical plates 4 are connected to the base 21 in a manner that allows movement in directions that can change the gap size between plates, and movement of the two vertical plates 4 is made equidistant by a centering mechanism. Since the guide slits 3 of knife guide 22 are positioned at the center of the gap created between the two vertical plates 4, this food holder 1 has the characteristic that thick food as well as thin food can be evenly cut in half.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims or equivalence of such metes and bounds thereof are therefore intended to be embraced by the claims.

What is claimed is:

1. A combination of an electric knife and a food holder, said food holder comprising:

a) a base structure;

b) two parallel vertical plates extending vertically from said base structure, wherein said vertical plates are spaced so as to define a food receiving gap; and c) two knife blade guides extending vertically from said base structure and positioned adjacent opposite sides of the food receiving gap, respectively, wherein each of said knife blade guides has a vertical blade guide slit which is aligned with a center of the food receiving gap, said electric knife comprising:

a main housing having a front end and a bottom surface;

a pair of cutting blades connected to the front end of said main housing, said cutting blades being received in the vertical blade guide slits of said knife blade guides; and a stand leg projecting from the bottom surface of said main housing, said stand leg being located on a blade-side of said main housing, wherein said stand leg has a length that is sufficient to prevent said cutting blades from contacting a lowermost end of said vertical blade guide slits when said food holder is supported on a supporting surface.

2. The combination as claimed in claim 1, wherein an upper portion of said main housing defines a gripping portion.

3. The combination as claimed in claim 1, wherein said main housing includes a long narrow opening extending parallel to the bottom surface, and a portion of said main housing above the opening is employed as a grip.

4. The combination as claimed in claim 1, wherein the bottom surface of said main housing is inclined at an angle of from 3 degrees to 20 degrees relative to the supporting surface when said main housing is supported on the supporting surface by said stand leg.

5. The combination as claimed in claim 1, wherein the bottom surface of said main housing is inclined at an angle of from 5 degrees to 15 degrees relative to the supporting surface when said main housing is supported on the supporting surface by said stand leg.

6. The combination as claimed in claim 1, wherein said stand leg has a bottom edge, and the bottom edge has a width of 10 mm to 30 mm.

7. The combination as claimed in claim 1, wherein said stand leg has a bottom edge, and the bottom edge has a width of 15 mm to 25 mm.

* * * * *